US006534255B1

(12) United States Patent
Delfino et al.

(10) Patent No.: US 6,534,255 B1
(45) Date of Patent: Mar. 18, 2003

(54) LIGHT-SENSITIVE SILVER HALIDE PHOTOGRAPHIC ELEMENT

(75) Inventors: Gerolamo Delfino, Savona (IT); Roberta Ganduglia, Vado Ligure (IT)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 08/835,828

(22) Filed: Jul. 1, 1997

Related U.S. Application Data

(63) Continuation of application No. 08/489,760, filed on Jun. 13, 1995, now abandoned.

(30) Foreign Application Priority Data

Jul. 21, 1994 (EP) ..... 94111358

(51) Int. Cl.[7] ..... G03C 1/035; G03C 1/09; G03C 1/10; G03C 1/30

(52) U.S. Cl. ..... 430/567; 430/603; 430/605; 430/622

(58) Field of Search ..... 430/603, 605, 430/622, 567

(56) References Cited

U.S. PATENT DOCUMENTS

| | | | | |
|---|---|---|---|---|
| 2,598,079 | A | 5/1952 | Stauffer et al. | 430/605 |
| 4,173,481 | A | 11/1979 | Sera et al. | |
| 4,307,183 | A | 12/1981 | Delfino | |
| 5,112,733 | A | 5/1992 | Ihama | |

FOREIGN PATENT DOCUMENTS

| | | |
|---|---|---|
| EP | 0 027 259 A1 | 4/1981 |
| EP | 0 348 934 A2 | 1/1990 |
| EP | 0 368 304 A1 | 5/1990 |
| EP | 0 443 453 A1 | 8/1991 |
| EP | 0 495 253 A1 | 7/1992 |
| EP | 0 560 118 A2 | 9/1993 |
| EP | 0 576 910 A1 | 1/1994 |
| WO | WO 92/12462 | 7/1992 |

*Primary Examiner*—Richard L. Schilling

(57) ABSTRACT

A light-sensitive silver halide photographic element comprising a support and at least one hydrophilic colloid layer comprising a binder and a vinylsulfonyl type hardener coated thereon, wherein at least one of said hydrophilic colloid layers is a silver halide emulsion layer containing tabular silver halide grains having an average diameter-:thickness ratio of at least 3:1, characterized in that said tabular silver halide grains are chemically sensitized by at least one gold sensitizer and at least one thiosulfonate sensitizer in the presence of a palladium compound added during chemical sensitization.

The silver halide photographic elements of the present invention can be advantageously developed in hardener free developer and used in high temperature rapid processing in automatic processors which include transporting rollers, have good photographic and physical characteristics and are free from surface defects.

20 Claims, No Drawings

LIGHT-SENSITIVE SILVER HALIDE PHOTOGRAPHIC ELEMENT

This is a Continuation of application Ser. No. 08/489,760, filed Jun. 13, 1995, now abandoned.

FIELD OF THE INVENTION

This invention relates to a light-sensitive silver halide photographic element and in particular, to a light-sensitive photographic element comprising tabular silver halide grains. The light-sensitive silver halide photographic elements of the present invention are advantageously developed without surface defects by super rapid processing in automatic processors which include transport rollers.

BACKGROUND OF THE INVENTION

Tabular silver halide grains are crystals possessing two major faces that are substantially parallel. The average diameter of said faces is at least three times the distance separating them (the thickness), this is generally described in the art as an aspect ratio of at least 3.

Silver halide photographic emulsions containing a high proportion of tabular Is grains have advantages of good developability, improved covering power and increased useful adsorption of sensitizing dye per weight of silver due to their high surface area-to-volume ratio. The use of such emulsions in photographic elements is disclosed in U.S. Pat. Nos. 4,425,425, 4,425,426, 4,433,048, 4,435,499, 4,439,520, and other related patents.

The use of automatic processors for rapid processing (i.e., for a processing of from 45 to 90 sec) of light-sensitive silver halide elements including tabular silver halide grains, and in particular for light-sensitive silver halide elements for radiographic use, is known. Such silver halide elements generally include a support (usually provided with a very thin subbing layer) having coated on at least one side a silver halide gelatin emulsion layer coated in turn with a gelatin protective layer. These elements are transported through machine processing units (developing, fixing, washing and drying) by means of opposed or staggered rollers (as described, for example, in U.S. Pat. No. 3,025,779) which also have the function of squeezing liquid from the film prior to drying. In recent years the increased use of silver halide elements for radiography has increased the desire for a reduction of processing times. In rapid processing of films , several problems can occur, such as inadequate image density (i.e. insufficient sensitivity, contrast and maximum density), insufficient fixing, insufficient washing, and insufficient film drying. Insufficient fixing and washing of a film cause a progressive worsening of the image quality and modification of the silver tone. To reduce the time taken by the element to pass through the processing machine to 0.5 to 2 minutes, as is particularly required in rapid processing of radiographic elements, processing is performed at relatively higher temperatures, usually higher than 30° C., preferably between 35–45° C., such as 38° C., and the gelatin content of the silver halide emulsions is considerably reduced as compared to that of emulsions for manual processing.

Under such conditions, even with the changes in the emulsions, the physical and photographic properties of the elements processed in an automatic processor tend to be worse. With higher temperatures and in the presence of lower gelatin content, the intrinsic sensitivity to pressure of the silver halide grains tends to be higher and the elements processed in the automatic processor show marks caused by the pressure of the transporting rollers. Such pressure marks look like higher density regions and reduce the image faithfulness.

To prevent pressure marking, various methods have been described in the art. To this purpose, U.S. Pat. No. 2,960,404 describes the use in the photographic elements of glycerine, ethylene glycol and the like, Japanese Pat. No. 5316/1972 describes the use of 1,4-cyclohexane dimethanol and the like, and Japanese Pat. No. 4939/1978 describes the use of trimethylol propane. Another method of preventing pressure marking is by increasing the degree of hardening of the gelatin layers, in particular of the external protective layers. As another method, photographic elements are known wherein an intermediate gelatin layer is interposed between the support and the emulsion layer. For example, U.S. Pat. No. 3,637,389 describes a rapid processing photographic element wherein gradation, density and sensitivity are improved by applying such an intermediate gelatin layer between the support and the emulsion layer.

However, known methods of preventing pressure marking when used in photographic elements including tabular silver halide grains have proved less effective. In particular, when the hardening degree is increased to achieve a very low swelling index and to improve its resistance to pressure desensitization, photographic characteristics are reduced. Accordingly, the problem still remains of preventing pressure marking in photographic elements including light-sensitive tabular silver halide emulsions.

EP Patent Application No. 560,118 discloses a light-sensitive silver halide photographic element comprising a support and at least one silver halide emulsion layer containing tabular silver halide grains having an average diameter:thickness of at least 3:1 and highly deionized gelatin, said photographic element having a swelling index lower than 140% and a melting time of from 45 to 120 minutes. The above swelling index and melting time were obtained by hardening the gelatin with a vinylsulfonyl type hardener containing hydroxy group(s). The light-sensitive element disclosed in said EP application can be advantageously developed by high temperature super rapid processing in automatic processors which include transport rollers and provides good physical and photographic characteristics. Unfortunately, a defect in the form of white streaks has been evidenced on the surface of said films upon processing. The cause of such a defect has been extensively studied and attributed to the reaction of the vinylsulfonyl type hardener with a compound used in the chemical sensitization of the tabular silver halide grains.

To obtain the photographic characteristics (speed, minimum and maximum density, contrast, tone of the developed silver) required by the medical radiographic applications in EP 560,118, chemical sensitization of the tabular silver halide grains comprised the use of gold and thiosulfonate sensitizers in the presence of a sulfinate compound. The purpose of the sulfinate compound was to prevent fog (minimum density) during chemical ripening and retard chemical ripening to obtain a better speed/fog ratio. It has been, however, found that the vinylsulfonyl type hardeners are capable of reacting with sulfinate compounds and give water insoluble products which can create deposits in the form of white streaks on the surface of processed photographic films. By using hardeners different from vinylsulfonyl type hardeners or avoiding sulfinate compounds, the appearance of said white streaks is eliminated, but either rapid processability or photographic characteristics are negatively affected.

It is, therefore, one aspect of the present invention to provide a silver halide photographic element comprising tabular silver halide grains which can be developed by high temperature super rapid processing in automatic processors which include transporting rollers and have good photographic and physical characteristics and is free from surface defects.

U.S. Pat. No. 4,425,426 discloses radiographic elements comprising thin tabular silver halide grains. The preferred chemical sensitizers for tabular silver halide grains described in said patent are gold and sulfur sensitizers, gold and selenium sensitizers, and gold, sulfur and selenium sensitizers.

EP 348,934 discloses a silver halide color photographic material comprising tabular silver halide grains reduction-sensitized in the presence of a thiosulfonate compound and chemical sensitized, e.g., gold sensitized and/or sulfur and selenium sensitized.

EP 443,453 describes a silver halide photographic emulsion comprising tabular silver halide grains which have been subjected to chemical sensitization by at least one selenium sensitizer, at least one gold sensitizer and at least one sulfur sensitizer. A palladium compound can be added to the silver halide emulsion before desalting is started.

U.S. Pat. No. 5,112,733 discloses a silver halide emulsion subjected to selenium sensitization in the presence of a defined amount of a palladium compound. In addition to selenium sensitization, the emulsion may be subjected to sulfur and/or gold sensitization. The palladium compound is preferably added to the emulsion before chemical sensitization. Tabular silver halide grains can be also used.

WO 92/12462 discloses a photographic material composed of a silver chloride or silver bromochloride emulsion stabilized against speed change and fog growth by addition of a thiosulfonate compound and a sulfinate compound. Preferably, the compounds are added to the emulsion just prior to coating. No reference is made in this patent application to tabular silver halide grains.

EP 495,253 describes a method for the production of a silver image by development of an image-wise exposed photographic silver halide element with a developer containing hydroquinone in the presence of an auxiliary developing agent, wherein said element contains silver halide grains chemically sensitized with thiosulfonate compounds in combination with a gold sensitizer in the absence of thiosulfate compounds. Preferably, the silver halide grains comprise at least 50% mol chloride and the element is used in Graphic Arts industry for obtaining high contrast development.

SUMMARY OF THE INVENTION

The present invention relates to a light-sensitive silver halide photographic element comprising a support and at least one hydrophilic colloid layer comprising a binder and a vinylsulfonyl type hardener coated thereon, wherein at least one of said hydrophilic colloid layers is a silver halide emulsion layer containing tabular silver halide grains having an average diameter:thickness ratio of at least 3:1, characterized in that said tabular silver halide grains are chemically sensitized by at least one gold sensitizer and at least one thiosulfonate sensitizer in the presence of a palladium compound added during chemical sensitization.

Preferably, the vinylsulfonyl type hardener is a bi-, tri- or tetra-vinylsulfonyl substituted organic hydroxy compound of formula $(CH_2{=}CH{-}SO_2{-})_n{-}A$, wherein A is an n-valent organic group containing at least one hydroxy group and n is 2, 3 or 4.

Most preferably, the silver halide photographic element comprises tabular silver halide grains which exhibit supersensitization, said grains being spectrally sensitized with cyanine dyes in addition with polymeric compounds having aminoallylidenemalononitrile moieties.

The silver halide photographic elements of the present invention can be advantageously developed by high temperature rapid processing in automatic processors which include transporting rollers, have good photographic and physical characteristics and are free from surface defects.

DETAILED DESCRIPTION OF THE INVENTION

The present invention relates to a light-sensitive silver halide photographic element comprising a support and at least one hydrophilic colloid layer comprising a binder and a vinylsulfonyl hardener coated thereon, wherein at least one of said hydrophilic colloid layers is a silver halide emulsion layer containing tabular silver halide grains having an average diameter:thickness ratio of at least 3:1, characterized in that said tabular silver halide grains are chemically sensitized by at least one gold sensitizer and at least one thiosulfonate sensitizer in the presence of a palladium compound added during chemical sensitization.

The tabular silver halide grains contained in the silver halide emulsion layers of this invention have an average diameter:thickness ratio (often referred to in the art as aspect ratio) of at least 3:1, preferably 3:1 to 20:1, more preferably 3:1 to 14:1, and most preferably 3:1 to 8:1. Average diameters of the tabular silver halide grains suitable for use in this invention range from about 0.3 to about 5 $\mu$m, preferably 0.5 to 3 $\mu$m, more preferably 0.8 to 1.5 $\mu$m. The tabular silver halide grains suitable for use in this invention have a thickness of less than 0.4 $\mu$m, preferably less than 0.3 $\mu$m and more preferably within 0.2 to 0.3 $\mu$m.

The tabular silver halide grain dimensions and characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains of the invention, at least 15%, preferably at least 25%, and, more preferably, at least 50% of the silver halide grains are tabular grains having an average diameter:thickness ratio of not less than 3:1. Each of the above proportions, "15%", "25%" and "50%" means the proportion of the total projected area of the tabular grains having a diameter:thickness ratio of at least 3:1 and a thickness lower than 0.4 $\mu$m, as compared to the projected area of all of the silver halide grains in the layer. Other conventional silver halide grain structures such as cubic, orthorhombic, tetrahedral, etc. may make up the remainder of the grains.

In the present invention, commonly employed halogen compositions of the silver halide grains can be used. Typical silver halides include silver chloride, silver bromide, silver iodide, silver chloroiodide,. silver bromoiodide, silver chlorobromoiodide and the like. However, silver bromide and silver bromoiodide are preferred silver halide compositions for tabular silver halide grains with silver bromoiodide compositions containing from 0 to 10 mol% silver iodide, preferably from 0.2 to 5 mol % silver iodide, and more preferably from 0.5 to 1.5% mol silver iodide. The halogen composition of individual grains may be homogeneous or heterogeneous.

Silver halide emulsions containing tabular silver halide grains can be prepared by various processes known for the preparation of photographic materials. Silver halide emulsions can be prepared by the acid process, neutral process or ammonia process. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No.2 (1962), pp. 121–125, in Gutoff, "Nucleation and Growth Rates During the Precipitation of Silver Halide Photographic Emulsions", Photographic Science and Engineering, Vol. 14, No. 4 (1970), pp. 248–257, in Berry et al., "Effects of Environment on the Growth of Silver Bromide Microcrystals", Vol.5, No.6 (1961), pp. 332–336, in U.S. Pat. Nos. 4,063,951, 4,067,739, 4,184,878, 4,434,226, 4,414,310, 4,386,156, 4,414,306 and in EP Pat. Appln. No. 263,508.

In preparing the silver halide emulsions containing tabular silver halide grains, a wide variety of hydrophilic dispersing agents for the silver halides can be employed. Gelatin is preferred, although other colloidal materials such as gelatin derivatives, colloidal albumin, cellulose derivatives or synthetic hydrophilic polymers can be used as known in the art. Highly deionized gelatin is particularly preferred. Highly deionized gelatin is characterized by a higher deionization with respect to the commonly used photographic gelatins. Preferably, the gelatin for use in the present invention is almost completely deionized which is defined as meaning that it presents less than 50 ppm (parts per million) of $Ca^{++}$ ions and is practically free (less than 5 parts per million) of other ions such as chlorides, phosphates, sulfates and nitrates, compared with commonly used photographic gelatins having up to 5,000 ppm of $Ca^{++}$ ions and the significant presence of other ions.

The highly deionized gelatin can be employed not only in the silver halide emulsion layers containing tabular silver halide grains, but also in other component layers of the photographic element, such as silver halide emulsion layers containing other than tabular silver halide grains, overcoat layers, interlayers and layers positioned beneath the emulsion layers. In the present invention, preferably at least 50%, more preferably at least 70% of the total hydrophilic colloid of the photographic element comprises highly deionized gelatin. The amount of gelatin employed in the light-sensitive photographic material of the present invention is such as to provide a total silver to gelatin ratio higher than 1 (expressed as grams of Ag/grams of gelatin). In particular the silver to gelatin ratio of the silver halide emulsion layers is in the range of from 1 to 1.5.

The manufacturing process of silver halide elements usually comprises a grain formation step, a desalting step, a chemical sensitization step, and a coating step. Chemical sensitization is performed by adding chemical sensitizers and other additional compounds to the silver halide emulsion, followed by the so-called chemical ripening at high temperature for a predetermined period of time. Chemical sensitization can be performed by various chemical sensitizers such as gold, sulfur, reducing agents, platinum, selenium, sulfur plus gold, and the like. The tabular silver halide grains for use in the present invention, after grain formation and desalting, are chemically sensitized by at least one gold sensitizer and at least one thiosulfonate sensitizer. During chemical sensitization other compounds can be added to improve the photographic performances of the resulting silver halide emulsion, such as, for example, antifoggants, stabilizers, optical sensitizers, supersensitizers, and the like.

Gold sensitization is performed by adding a gold sensitizer to the emulsion and stirring the emulsion at high temperature of preferably 40° C. or more for a predetermined period of time. As a gold sensitizer, any gold compound which has an oxidation number of +1 or +3 and is normally used as gold sensitizer can be used. Preferred examples of gold sensitizers are chloroauric acid, the salts thereof and gold complexes, such as those described in U.S. Pat. No. 2,399,083. It is also useful to increase the gold sensitization by using a thiocyanate together with the gold sensitizer, as described, for example, in T. H. James, The Theory of the Photographic Process, 4th edition, page 155, published by MacMillan Co., 1977. Specific examples of gold sensitizers include chloroauric acid, potassium chloroaurate, auric trichloride, sodium aurithiosulfate, potassium aurithiocyanate, potassium iodoaurate, tetracyanoauric acid, 2-aurosulfobenzothiazole methochloride and ammonium aurothiocyanate.

Thiosulfonate sensitization is performed by adding a thiosulfonate sensitizer to the tabular silver halide emulsion and stirring the emulsion at a high temperature of 40° C. or more for a predetermined period of time. Thiosulfonate sensitizers in the present invention can be represented by the following general formula:

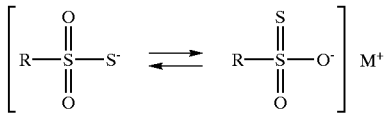

wherein R represents an aliphatic group, an aromatic group or a heterocyclic group and $M^+$ represents a cation.

The aliphatic group represented by R can be a saturated or unsaturated, straight-chain, branched or cyclic aliphatic hydrocarbon group and is preferably an alkyl group of 1 to 22 carbon atoms (such as methyl, ethyl, propyl, butyl, pentyl, hexyl, 2-ethylhexyl, decyl, dodecyl, octadecyl, cyclohexyl and t-butyl), an alkenyl group of 2 to 22 carbon atoms (such as allyl and butenyl), or an alkinyl group of 2 to 22 carbon atoms (such as propargyl and butynyl).

The aromatic group represented by R includes single-ring or condensed-ring aromatic groups and has preferably 6 to 20 carbon atoms (such as phenyl, tolyl and naphthyl).

The heterocyclic group represented by R includes a 5- or 6-membered heterocyclic group having one or more heteroatoms (such as nitrogen, oxygen, sulfur, selenium and tellurium). Examples of suitable heterocyclic groups are pyrrolyl, furanyl, piperidino, morpholino, pyridino, picolino, pyrrolidino, thiophene, oxazole, benzoxazole, triazole, tetrazole, thiazole, benzothiazole and thiadiazole. The aliphatic, aromatic and heterocyclic groups represented by R can have substituents.

$M^+$ is preferably a metal ion or an organic cation. Examples of metal ions are $Li^+$, $Na^+$ and $K^+$. Examples of organic cations are an ammonium ion (such as ammonium, tetramethylammonium and tetrabutylammonium), a phosphonium ion (such as tetraphenylphosphonium) and a guanidyl group.

In the most preferred embodiment, R is a tolyl group and M is $Na^+$ or $K^+$.

When the term "group" is used in this invention to describe a chemical compound or substituent, the described chemical material includes the basic group and that group with conventional substitution. When the term "moiety" is used to describe a chemical compound or substituent, only an unsubstituted chemical material is intended to be included. For example, "alkyl group" includes not only such alkyl moieties as methyl, ethyl, octyl,, stearyl, etc., but also such moieties bearing substituents groups such as halogen, cyano, hydroxy, nitro, amino, carboxylate, etc. On the other hand, "alkyl moiety" includes only methyl, ethyl, octyl, stearyl, cyclohexyl, etc.

The amounts of the gold sensitizer and the thiosulfonate sensitizer for use in the present invention change in accordance with the various conditions, such as activity of the gold and thiosulfonate sensitizer, type and size of tabular silver halide grains, temperature, pH and time of chemical ripening. These amounts, however, are preferably from 1 to 20 mg of gold sensitizer per mol of silver, and from 1 to 100 mg of thiosulfonate sensitizer per mol of silver. The temperature of chemical ripening is preferably 45° C. or more, and more preferably 50° C. to 80° C. The pAg and pH may take arbitrary values.

During chemical sensitization, addition times and order of gold sensitizer and thiosulfonate sensitizer are not particularly limited. For example, gold and thiosulfonate sensitizers can be added at the initial stage of chemical sensitization or at a later stage either simultaneously or at different times. Usually, gold and thiosulfonate sensitizers are added to the tabular silver halide emulsion by their solutions in water, in a water-miscible organic solvent, such as methanol, ethanol and acetone, or as a mixture thereof.

According to the present invention, a palladium compound is added to the tabular silver halide emulsion during chemical sensitization, after grain formation and desalting in the process of manufacturing the silver halide emulsion. The tabular silver halide emulsion is subjected to chemical sensitization with a gold sensitizer and a thiosulfonate sensitizer in the presence of a palladium compound added during chemical sensitization in an amount of 0.5 to 50 mg/Ag mole. More preferably, the tabular silver halide emulsion is subjected to chemical sensitization with a gold sensitizer and a thiosulfonate sensitizer in the presence of a palladium compound added during chemical sensitization in an amount of from 1 to 10 mg/Ag mole.

"Addition of a palladium compound during chemical sensitization" means that the palladium compound is added to a silver halide emulsion at any time after the desalting step and before the end of the chemical ripening. That is, the palladium compound can be added either simultaneously to the addition of chemical sensitizer or can be added in a subsequent step or previous step, during chemical sensitization. According to a preferred embodiment of the invention the palladium compound is added after the addition of gold and thiosulfonate sensitizers.

The palladium compound for use in the present invention is a salt of $Pd^{2+}$ or $Pd^{4+}$, preferably represented by the formulas $R_1PdX_6$ or $R_1PdX_4$, wherein $R_1$ represents a hydrogen atom, an alkali metal atom or an ammonium group, and X represents a halogen atom, such as chlorine, bromine and iodine. Preferred examples of palladium compounds are $K_2PdCl_4$, $Na_2PdCl_4$, $Li_2PdCl_4$, $(NH_4)_2PdCl_4$, $(NH_4)_2PdCl_6$, $Na_2PdCl_6$ and $K_2PdBr_4$. Other examples of palladium compounds for use in the present invention include $PdCl_2$, $PdBr_2$, $PdSO_4$, $Pd(NH_3)_4Cl_2$, PdO, $Pd(OH)_2$, $Na_2Pd(NO_2)_4$, $K_2Pd(CN)_4$, $Pd(C_6COO)_2$ and Pd(PPh3)$_4$. Most preferably, the palladium compound is used in combination with thiocyanate ions in a molar amount of five times or more that of the palladium compound. The palladium compound added during chemical sensitization of tabular silver halide emulsion by gold and thiosulfonate sensitizers has been found to suppress fogging by retarding the ripening process and to give a better fog/sensitivity ratio.

The tabular silver halide emulsions of the present invention are preferably spectrally sensitized. It is specifically contemplated to employ in the present invention, in combination with the tabular silver halide emulsions, spectral sensitizing dyes having absorption maxima in the blue, minus blue (i.e., green and red) and infrared portions of the electromagnetic spectrum. Spectral sensitizing dyes for use in the present invention include polymethine dyes, such as cyanine and complex cyanine dyes, merocyanine and complex merocyanine dyes, as well as other dyes, such as oxonols, hemioxonols, styryls, merostyryls and streptocyanines as described by F. M. Hamer, The Cyanine and Related Compounds, Interscience Publishers, 1964.

The cyanine dyes include, joined by a methine linkage, two basic heterocyclic nuclei, such as pyrrolidine, oxazoline, thiazoline, pyrrole, oxazole, thiazole, selenazole, tetrazole and pyridine and nuclei obtained by fusing an alicyclic hydrocarbon ring or an aromatic hydrocarbon ring to each of the above nuclei, such as indolenine, benzindolenine, indole, benzoxazole, naphthoxazole, benzothiazole, naphthothiazole, benzoselenazole, benzimidazole and quinoline. These nuclei can have substituents groups.

The merocyanine dyes include, joined by a methine linkage, a basic heterocyclic nucleus of the type described above and an acid nucleus, such as a 5- or 6-membered heterocyclic nucleus derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1-3-dione, and isoquinolin4-one.

Of the above dyes, dyes most effectively used in the present invention are cyanine dyes, such as those represented by the following formula:

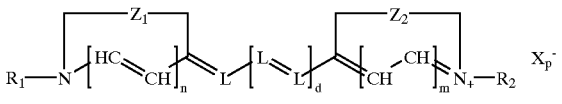

wherein n, m and d each independently represents 0 or 1, L represents a methine linkage, e.g., =CH—, ≡C($C_2H_5$), etc., $R_1$ and $R_2$ each represents a substituted or unsubstituted alkyl group, preferably a lower alkyl group of from 1 to 4 carbon atoms, e.g., methyl, ethyl, propyl, butyl, cyclohexyl and dodecyl, a hydroxyalkyl group, e.g., β-hydroxyethyl and Ω-hydroxybutyl, an alkoxyalkyl group, e.g., β-methoxyethyl and Ω-buthoxyethyl, a carboxyalkyl group, e.g., β-carboxyethyl and Ω-carboxybutyl, a sulfoalkyl group, e.g., β-sulfoethyl and Ω-sulfobutyl, a sulfatoalkyl group, e.g., β-sulfatoethyl and Ω-sulfatobutyl, an acyloxyalkyl group, e.g., β-acetoxyethyl, γ-acetoxypropyl and Ω-butyryloxybutyl, an alkoxycarbonylalkyl group, e.g., β-methoxycarbonylethyl and Ω-ethoxycarbonylbutyl, benzyl, phenethyl, or an aryl group of up to 30 carbon atoms, e.g., phenyl, tolyl, xylyl, chlorophenyl and naphthyl, X represents an acid anion, e.g., chloride, bromide, iodide, thiocyanate, sulfate, perchlorate, p-toluenesulfonate and methylsulfate; said methine linkage forming an intramolecular salt when p is 0; $Z_1$ and $Z_2$, the same or different, each represents the non metallic atoms necessary to complete the same simple or condensed 5- or 6-membered heterocyclic nucleus, such as a benzothiazole nucleus (e.g., benzothiazole, 3-, 5-, 6- or 7-chloro-benzothiazole, 4-, 5- or 6-methylbenzothiazole, 5- or 6-bromobenzothiazole, 4- or 5-phenyl-benzothiazole, 4-, 5- or 6-methoxybenzothiazole, 5,6-dimethyl-benzothiazole and 5- or 6-hydroxybenzothiazole), a naphthothiazole nucleus (e.g., α-naphthothiazole, β-naphthothiazole, 5-methoxy-β-naphthothiazole, 5-ethoxy-α-naphthothiazole and 8-methoxy-α-naphthothiazole), a benzoselenazole nucleus (e.g., benzoselenazole, 5-chloro-benzoselenazole and tetrahydrobenzoselenazole), a naphthoselenazole nucleus (e.g., α-naphtho-selenazole and β-naphthoselenazole), a benzoxazole nucleus (e.g., benzoxazole, 5- or 6-hydroxybenzoxazole, 5-chloro-benzoxazole, 5- or 6-methoxybenzoxazole, 5-phenyl-benzoxazole and 5,6-dimethylbenzoxazole), a naphthoxazole nucleus (e.g., α-naphthoxazole and β-naphthoxazole), a 2-quinoline nucleus (e.g., 2-quinoline, 6-, 7, or 8-methyl-2-quinoline, 4-, 6- or 8-chloro-2-quinoline, 5-, 6- or 7-ethoxy-2-quinoline and 6- or 7-hydroxy-2-quinoline), a 4-quinoline nucleus (e.g., 4-quinoline, 7- or 8-methyl-4-quinoline and 6-methoxy-4-quinoline), a benzimidazole nucleus (e.g., benzimidazole, 5-chloro-benzimidazole and 5,6-dichlorobenzimidazole), a thiazole nucleus (e.g., 4- or 5-methylthiazole, 5-phenyl-thiazole and 4,5-di-methyl-thiazole), an oxazole nucleus (e.g., 4- or 5-methyl-oxazole, 4-phenyloxazole, 4-ethyl-oxazole and 4,5-dimethyl-oxazole), and a selenazole nucleus (e.g., 4-methyl-selenazole and 4-phenylselenazole. More preferred dyes within the above class are those having an internal salt group and/or derived from benzoxazole and benzimidazole nuclei as indicated before. Typical methine spectral sensitizing dyes for use in the present invention include those listed below.

Dye A

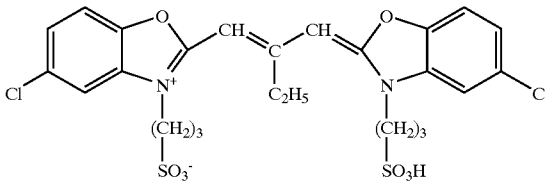

-continued

Dye B

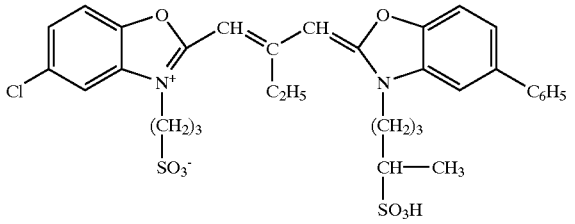

Dye C

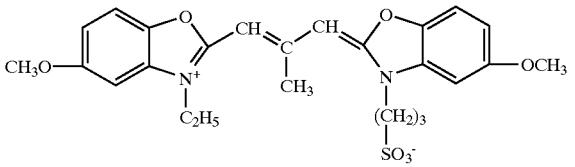

Dye D

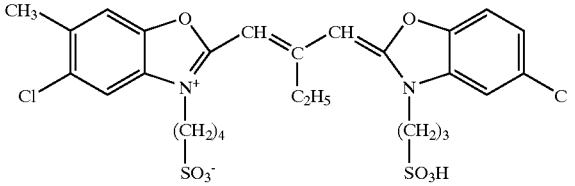

Dye E

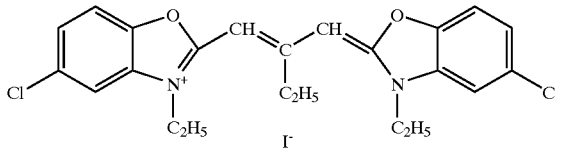

Dye F

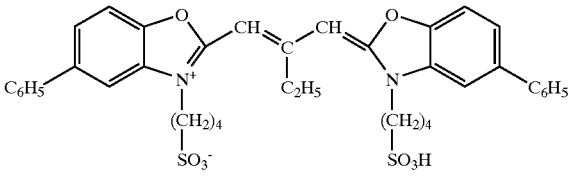

Dye G

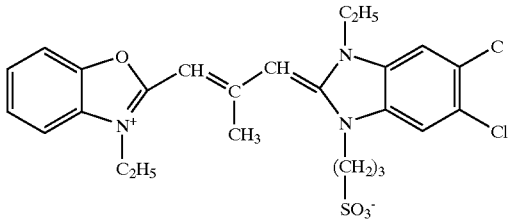

The methine spectral sensitizing dyes for use in this invention are generally known in the art. Particular reference can be made to U.S. Pat. Nos. 2,503,776, 2,912,329, 3,148,187, 3,397,060, 3,573,916 and 3,822,136 and FR Pat. No. 1,118,778. Also their use in photographic emulsions is very known wherein they are used in optimum concentrations corresponding to desired values of sensitivity to fog ratios. Optimum or near optimum concentrations of spectral sensitizing dyes in the emulsions of the present invention generally go from 10 to 500 mg per mol of silver, preferably from 50 to 200, more preferably from 50 to 100.

Spectral sensitizing dyes can be used in combinations which result in supersensitization, i.e., spectral sensitization which is greater in a spectral region than that from any concentration of one dye alone or which would result from an additive effect of the dyes. Supersensitization can be obtained with selected combinations of spectral sensitizing dyes and other addenda, such as stabilizers and antifoggants, development accelerators and inhibitors, optical brighteners, surfactants and antistatic agents, as described by Gilman, Photographic Science and Engineering, 18, pp. 418–430, 1974 and in U.S. Pat. Nos. 2,933,390, 3,635,721, 3,743,510, 3,615,613, 3,615,641, 3,617,295 and 3,635,721.

Preferably in the present invention, spectral sensitizing dyes are used in supersensitizing combination with polymeric compounds containing an aminoallylidenemalononitrile (>N—CH═CH—CH═$(CN)_2$) moiety, as those described in U.S. Pat. No. 4,307,183. Said polymeric compounds are preferably obtained upon copolymerization of an allyl monomer which has an ethylenically condensed aminoallylidenemalononitrile moiety (such as dilallylaminoallylidenemalononitile monomer therein with an ethylenically unsaturated monomer, said monomer being preferably a water-soluble monomer; said copolymerization being preferably a solution polymerization said polymeric compound being preferably a water-soluble polymer; said monomer more preferably being an acrylic or methacrylic monomer, most preferably being acrylamide or acrylic acid.

Examples of polymeric compounds which can be used in supersensitizing combination with spectral sensitizing dyes are preferably the polymeric compounds described in the following table wherein the monomer is copolymerized (in solution in the presence of a polymerization initiator) with a diallylaminoallylidenemalononitrile monomer, as well as a weight percent quantity of aminoallylidenemalononitrile moieties (AAMN) within the polymers themselves are indicated.

TABLE A

| Compound | Monomer | % AAMN |
|---|---|---|
| 1 | Acrylamide | 9 |
| 2 | Methacrylic acid | 11 |
| 3 | Acrylamide | 10.5 |
| 4 | Acrylic acid | 23 |
| 5 | Acrylamide | 44 |
| 6 | Vinylpirrolidone | 44 |
| 7 | Vinyloxazolidone | 14.5 |
| 8 | Vinyloxazolidone | 37 |
| 9 | Methacrylamide | 8 |
| 10 | Acrylamide-Allylamide.HCl | 10 |
| 11 | Acrylamide-Diallylamide.HCl | 7 |

Methods of preparation of said polymeric compounds are described in the above mentioned U.S. Pat. No. 4,307,183. The optimum concentrations of said polymeric compounds generally go from 10 to 1,000 mg per mol of silver, preferably from 50 to 500, more preferably from 150 to 350, the weight ratio of the polymeric compound to the spectral sensitizing dye normally being of 10/1 to 1/10, preferably 5/1 to 1/5, more preferably 2.5/1 to 1/1 (such a ratio of course depending upon the aminoallylidene-malononitrile moiety content of the polymeric compound: the higher such content, the lower such ratio).

Spectral sensitization can be performed at any stage of silver halide preparation. It can be performed subsequent to the completion of chemical sensitization or concurrently with chemical sensitization, or can precede chemical sensitization, or even can commence prior to the completion of silver halide precipitation. In the preferred form, spectral sensitizing dyes can be incorporated in the tabular grain silver halide emulsions prior to chemical sensitization.

The silver halide emulsion layer containing the tabular silver halide grains of this invention can contain other constituents generally used in photographic products, such as binders, hardeners, surfactants, speed-increasing agents, stabilizers, plasticizers, optical sensitizers, dyes, ultraviolet absorbers, etc., and reference to such constituents can be found, for example, in Research Disclosure, Vol. 176 (December 1978), pp. 22–28. Ordinary silver halide grains may be incorporated in the emulsion layer containing the tabular silver halide grains as well as in other silver halide emulsion layers of the light-sensitive silver halide photographic material of this invention. Such grains can be prepared by processes well known in the photographic art.

The silver halide photographic element of the present invention can be processed in a super-rapid processing of less than 45 seconds from the insertion of the photographic element in an automatic processor to the exit therefrom.

In a preferred embodiment of the present invention the light-sensitive silver halide photographic element of the present invention comprises a support and at least one silver halide emulsion layer, wherein at least one of said silver halide emulsion layers contains tabular silver halide grains having an average diameter:thickness ratio of at least 3:1 and highly deionized gelatin hardened with a bi-,tri-, or tetra-vinylsulfonyl substituted organic hydroxy compound of formula $(CH_2{=}CH{-}SO_2{-})_n{-}A$, wherein A is an n-valent organic group containing at least one hydroxy group and n is 2, 3 or 4.

In the above general formula, the group A represents an n-valent acyclic hydrocarbon group, a 5 or 6 membered heterocyclic group containing at least one nitrogen, oxygen or sulfur atom, a 5 or 6 membered alicyclic group or an aralkylene group having at least 7 carbon atoms. Each of these A groups may either have a substituent or combine with each other through a hetero atom, for example, a nitrogen, oxygen and/or sulfur atom, or a carbonyl or carbonamido group.

In the above general formula, the group A may be advantageously any organic divalent group, preferably an acyclic hydrocarbon group such as an alkylene group having 1 to 8 carbon atoms, e.g., a methylene group, an ethylene group, a trimethylene group, a tetramethylene group, etc., or an aralkylene group having a total of 8 to 10 carbon atoms. One to three of the carbon atoms of the group defined above for A can be replaced by a hetero atom such as a nitrogen atom, an oxygen atom, a sulfur atom, etc. Also, the group A can be additionally substituted, for example, with one or more alkoxy groups having 1 to 4 carbon atoms such as a methoxy group, an ethoxy group, etc., a halogen atom such as a chlorine atom, a bromine atom, etc., an acetoxy group and the like.

The above hydroxy substituted vinylsulfonyl hardeners can be prepared using known methods, e.g., methods similar to those described in U.S. Pat. No. 4,173,481.

Examples of compounds represented by the above given formula are given below.

1.

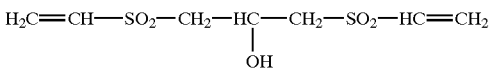

2.

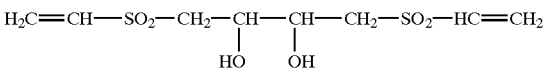

3.

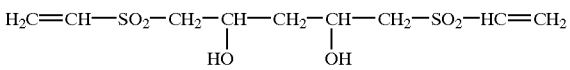

4.

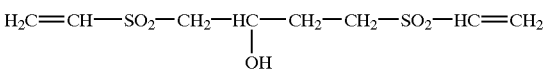

5.

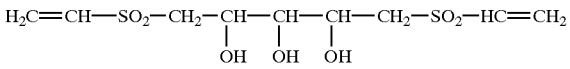

6.

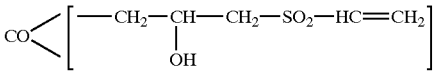

7.

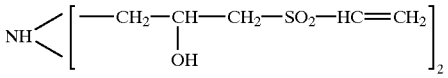

8.

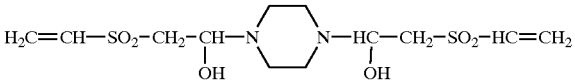

9.

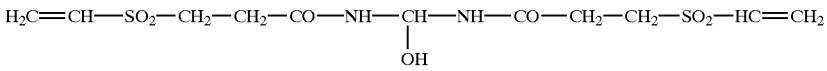

10.

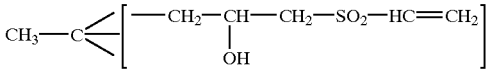

11.

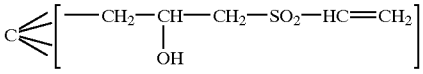

12.

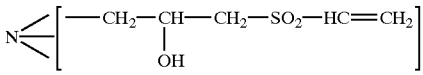

13.

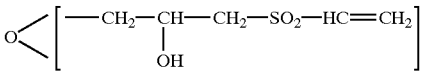

14.

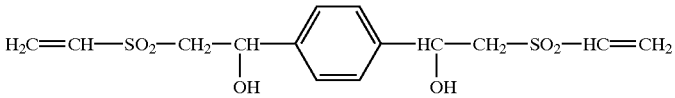

15.

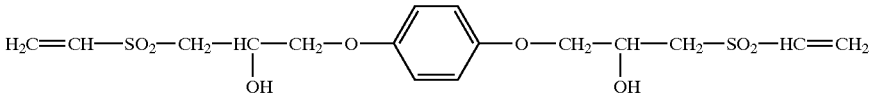

16.

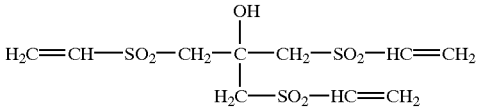

17.

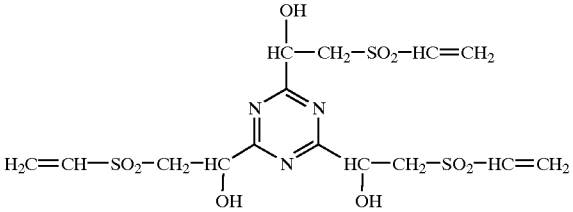

18.

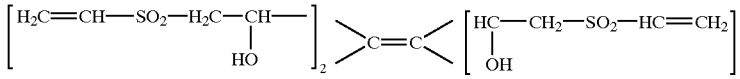

19.

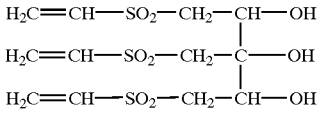

The above hydroxy-substituted vinylsulfonyl hardeners may be incorporated in the tabular silver halide emulsion layer comprising the deionized gelatin or in a layer of the light-sensitive silver halide photographic element having a water-permeable relationship with the tabular silver halide emulsion layer. Preferably, the hydroxy substituted vinylsulfonyl hardeners are incorporated in the tabular silver halide emulsion layer.

The amount of the above-mentioned hydroxy substituted vinylsulfonyl hardeners used in the tabular silver halide emulsion of the photographic material of this invention can be widely varied. Generally, the hydroxy substituted vinylsulfonyl hardener is used in amounts of from 0.5% to 10% by weight of highly deionized gelatin, although a range of from 1% to 5% by weight of highly deionized gelatin is preferred.

The silver halide photographic element according to the present invention can also be hardened by using a mixture of the above-mentioned vinylsulfonyl hardeners and a conventionally known hardener. Examples of useful conventional hardeners are aldehyde hardeners, such as formaldehye, glutaraldehyde and the like, active halogen hardeners, such as 2,4-dichloro-6-hydroxy-1,3,5-triazine, 2-chloro-4,6-hydroxy-1,3,5-triazine and the like, active vinyl hardeners, such as bisvinylsulfonyl-methane, 1,2-vinylsulfonyl-ethane, bisvinylsulfonyl-methyl ether, 1,2-bisvinylsulfonyl-ethyl ether, and the like, N-methylol hardeners, such as dimethylolurea, methyloldimethyl hydantoin and the like.

The hydroxy substituted vinylsulfonyl hardeners can be added to the silver halide emulsion layer containing said tabular silver halide grains and the highly deionized gelatin or other components layers of the photographic element utilizing any of the well-known techniques in emulsion making. For example, they can be dissolved in either water or a water-miscible solvent as methanol, ethanol, etc. and added into the coating composition for the above-mentioned silver halide emulsion layer or auxiliary layers.

The light-sensitive silver halide photographic element of this invention can be prepared by coating the light-sensitive silver halide emulsion layer or layers and other auxiliary layers on a support. Examples of materials suitable for the preparation of the support include glass, paper, polyethylene-coated paper, metals, polymeric film such as cellulose nitrate, cellulose acetate, polystyrene, polyethylene terephthalate, polyethylene naphthalate, polyethylene, polypropylene and other well known supports.

The light-sensitive silver halide photographic elements of this invention are applicable to light-sensitive photographic color materials such as color negative films, color reversal films, color papers, etc., as well as black-and-white light-sensitive photographic materials such as X-ray light-sensitive materials, lithographic light-sensitive materials, black-and-white photographic printing papers, black-and-white negative films, graphic art film, etc.

Preferred light-sensitive silver halide photographic materials according to this invention are radiographic light-sensitive materials used in X-ray imaging comprising a silver halide emulsion layer(s) coated on one surface, preferably on both surfaces of a support, preferably a polyethylene terephthalate support, wherein at least one of said silver halide emulsion layers contains tabular silver halide grains having an average diameter:thickness ratio of at least 3:1 and highly deionized gelatin hardened with the above mentioned hydroxy substituted vinylsulfonyl hardeners. Preferably, the silver halide emulsions are coated on the support at a total silver coverage in the range of 3 to 6 grams per square meter. Usually, the radiographic light-sensitive materials are associated with intensifying screens so as to be exposed to radiation emitted by said screens. The screens are made of relatively thick phosphor layers which transform the X-rays into more imaging-effective radiation such as light (e.g., visible light). The screens absorb a much larger portion of X-rays than the light-sensitive materials do and are used to reduce the X-ray dose necessary to obtain a useful image. According to their chemical composition, the phosphors can emit radiation in the ultraviolet, blue, green or red region of the visible spectrum and the silver halide emulsions are sensitized to the wavelength region of the radiation emitted by the screens. Sensitization is performed by using spectral sensitizing dyes adsorbed on the surface of the silver halide grains as known in the art.

More preferred light-sensitive silver halide photographic materials according to this invention are radiographic light-sensitive materials which employ intermediate diameter-:thickness ratio tabular grain silver halide emulsions, as disclosed in U.S. Pat. No. 4,425,426 and in EP Pat. Appln. 84,637.

The exposed light-sensitive materials of this invention can be processed by any of the conventional processing techniques. The processing can be black-and-white photographic processing for forming a silver image or color photographic processing for forming a dye image depending upon the purpose. Such processing techniques are illustrated for example in Research Disclosure, 17643, December 1978. Roller transport processing in an automatic processor is illustrated in U.S. Pat. Nos. 3,025,779, 3,515,556, 3,545,971 and 3,647,459 and in UK Pat. No. 1,269,268. Hardening development can be undertaken, as illustrated in U.S. Pat. No. 3,232,761.

In a preferred embodiment, a hardener free aqueous developing solution useful to develop the photographic material of the present invention comprises:

(1) at least one black-and-white developing agent,
(2) at least one black-and-white auxiliary developing agent,
(3) at least one antifoggant,
(4) at least one sequestering agent,
(5) sulfite antioxidant, and
(6) at least one buffering agent.

The developing agents for silver halide photographic elements suitable for the purposes of the present invention include hydroquinone and substituted hydroquinones (e.g. t-butylhydroquinone, methylhydroquinone, dimethylhydroquinone, chlorohydroquinone, dichlorohydroquinone, bromohydroquinone, 1,4-dihydroxynaphthalene, methoxyhydroquinone, ethoxyhydroquinone, etc.). Hydroquinone, however, is preferred. Said silver halide developing agents are generally used in an amount from about 2 to 100 grams per liter, preferably 6 to 50 grams per liter of the ready-to-use developer composition.

Such developing agents can be used alone or in combination with auxiliary developing agents which show a superadditive affect, such as p-aminophenol and substituted p-aminophenol (e.g. N-methyl-p-aminophenol (known as metol) and 2,4-diaminophenol) and pyrazolidones (e.g. 1-phenyl-3-pyrazolidone or phenidone) and substituted pyrazolidones (e.g., 4-methyl-1-phenyl-3-pyrazolidone, 4-hydroxymethyl4-methyl-1-phenyl-3-pirazolidone (known as dimezone S), and 4,4'-dimethyl-1-phenyl-3-pyrazolidone (known as dimezone). These auxiliary developing agents are generally used in an amount from about 0.1 to 10, preferably 0.5 to 5 grams per liter of ready-to-use developer composition.

The antifogging agents, known in the art to eliminate fog on the developed photographic silver halide films, include derivatives of benzimidazole, benzotriazole, tetrazole, indazole, thiazole, etc. Preferably, the developer comprises a combination of benzotriazole-, indazole- and mercaptoazole-type antifoggants, more preferably a combination of 5-methylbenzotriazole, 5-nitroindazole and 1-phenyl-5-mercaptotetrazole. Other examples of mercaptoazoles are described in U.S. Pat. No. 3,576,633, and other examples of indazole type antifoggants are described in U.S. Pat. No. 2,271,229. More preferably, particular mixtures of these antifogging agents are useful to assure low fog levels; such preferred mixtures include mixtures of 5-nitroindazole and benzimidazole nitrate, 5-nitrobenzotriazole and 1-phenyl-1-H-tetrazole-5-thiol and 5-methylbenzotriazole and 1-phenyl-1-H-tetrazole-5-thiol. The most preferred combination is 5-methylbenzotriazole and 1-phenyl-1-H-tetrazole-5-thiol. These mixtures are used in a total amount of from about 0.01 to 5, preferably 0.02 to 3 grams per liter of the ready-to-use developer composition. Of course optimum quantities of each compound and proportion can be found by the skilled in the art to respond to specific technical needs. In particular, 5-methylbenzotriazoles have been found to give the best results when used in mixture with 1-phenyl-1-H-tetrazole-5-thiol, the latter being present in minor amount with respect to the weight of the total mixture, in a percent of less than 20%, preferably less than 10%.

The developer, comprising said antifoggant combination, is advantageously used in a continuous transport processing machine at high temperature processing (higher than 30° C.) for processing of X-ray materials without changes in the sensitometric properties of the material, mainly without a substantial increase of the fog of the developed material.

The sequestering agents are known in the art such as, for example, aminopolycarboxylic acids (ethylenediaminotetraacetic acid, diethylenetriaminepentaacetic acid, nitrilotriacetic acid, diaminopropanoltetraacetic acid, etc.), aminopolyphosphonic acids (methylaminophosphonic acid, phosphonic acids described in Research Disclosure 18837 of December 1979, phosphonic acids described in U.S. Pat. No. 4,596,764, etc.), cyclicaminomethane diphosphonic acids (as described in EP Appl. No. 286,874), polyphosphate compounds (sodium hexametaphosphate, etc.), α-hydroxycarboxylic acid compounds (lactic acid, tartaric acid, etc.), dicarboxylic acid compounds (malonic acid, etc.), α-ketocarboxylic acid compounds as disclosed in U.S. Pat. No. 4,756,997 (pyruvic acid, etc.), alkanolamine compounds (diethanolamine, etc.), etc.

The above sequestering agents can be used alone or in combination each other. More preferably, particular mixtures of these sequestering agents are useful to assure strong resistance to air oxidation; such preferred mixtures include mixtures of aminopolycarboxylic acids and cyclicaminomethane diphosphonic acids as disclosed in EP 446,457. Said sequestering agents can be advantageously used in a total amounts of from about 1 to about 60 grams per liter, preferably of from about 2 to about 30 grams per liter of ready-to-use developer. Of course optimum quantities of each compound and proportion can be found by the skilled in the art to respond to specific technical needs. The sequestering agents have been found to increase the stability of the developer over a long period of time.

The term "sulfite antioxidants" means those compounds known in the art as capable of generating sulfite ions ($SO_3^{--}$) in aqueous solutions and include sulfites, bisulfites, metabisulfites (1 mole of metabisulfite forming 2 moles of bisulfite in aqueous solution). Examples of sulfites, bisulfites, and metabisulfites include sodium sulfite, sodium bisulfite, sodium metabisulfite, potassium sulfite, potassium bisulfite, potassium metabisulfite and ammonium metabisulfite. The amount of the total sulfite ions is preferably not less than 0.05 moles, more preferably 0.1 to 1.25 moles, and most preferably 0.3 to 0.9 moles, per liter of developer. The amount of the sulfite ions with respect to the hydroquinone preferably exceeds a molar ratio of 2.5:1 and, more preferably, is between 2.5:1 to 4:1.

The developer can further include a buffer (e.g., carbonic acid salts, phosphoric acid salts, polyphosphates, metaborates, boric acid and boric acid salts). Preferably, the developer does not comprise boric acid and/or boric acid salts. The amount of the buffer with respect to the sulfite preferably exceeds a molar ratio of 0.5:1 and, more preferably, is between 1:1 to 2:1.

The developer can further comprise silver halide solvents. Useful silver halides solvents are solutions or compounds well known in the art, such as soluble halide salts, (e.g., NaBr, KCl), thiosulfates (e.g. sodium thiosulfate, potassium thiosulfate and ammonium thiosulfate), sulfites (e.g., sodium sulfite), ammonium salts (e.g. ammonium chloride), thiocyanates (e.g., potassium thiocyanate, sodium thiocyanate, ammonium thiocyanate), thiourea, imidazole compounds (e.g., 2-methylimidazole as described in U.S. Pat. No. 3,708,299) and thioether compounds.

In a preferred embodiment the photographic developer can comprise thiosulfates and thiocyanates, alone or in combination with each other. In a more preferred embodiment the photographic developer comprises alkali metal or ammonium thiosulfates or thiocyanates, alone or in combination with each other. The amount of the silver halide solvent used varies depending on the type of the silver halide solvent. The total amount of the silver halide solvents is generally in the range of from 0.01 to 50 mMoles per liter, more preferably in the range of from 0.1 to 30 mMoles per liter of ready-to-use developer composition.

In the developer composition there are used inorganic alkaline agents to obtain the preferred pH which is usually higher than 10. Inorganic alkaline agents include KOH, NaOH, LiOH, sodium and potassium carbonate, etc.

Other adjuvants well known to the skilled in the art of developer formulation may be added to the developer. These include restrainers, such as the soluble halides (e.g., KBr), solvents (e.g., polyethylene glycols and esters thereof), development accelerators (e.g., polyethylene glycols and pyrimidinium compounds), preservatives, surface active agents, and the like.

The developer is prepared by dissolving the ingredients in water and adjusting the pH to the desired value. The pH value of the developer is in the range of from 9 to 12, more preferably of from 10 to 11. The developer may also be prepared in a single concentrated form and then diluted to a working strength just prior to use. The developer may also be prepared in two or more concentrated parts to be combined and diluted with water to the desired strength and placed in the developing tank of the automatic processing machine.

In a preferred embodiment, a hardener free aqueous fixing solution useful to fix the photographic material of the present invention comprises:

(1) at least one fixing agent, (2) at least one acid compound, (3) at least one buffering agent.

The fixing agents for silver halide photographic elements include thiosulfates, such as ammonium thiosulfate, sodium thiosulfate, potassium thiosulfate; thiocyanates, such as ammonium thiocyanate, sodium thiocyanates; sulfites, such as sodium sulfite, potassium sulfite; ammonium salts, such as ammonium bromide, ammonium chloride; and the like.

Acid compounds are sodium or potassium metabisulfates, boric acid, acetic acid, and the like.

The fixing solution further includes a buffer (e.g., carbonic acid salts, phosphoric acid salts, polyphosphates, metaborates, boric acid and boric acid salts, acetic acid and acetic acid salts, and the like).

Other components usually employed in fixing bath are disclosed, for example, in L. F. A. Mason, "Photographic Processing Chemistry", pp. 179–195, Focal Press Ltd., and in D. H. O. John, "Radiographic Processing", pp. 152–178, Focal Press Ltd., London.

In a preferred embodiment the fixing solution does not comprise boric acid and/or boric acid salts. The aim of boric acid is substantially related to its binding properties relative to the aluminum ion (used as gelatin hardener in conventional fixing solutions). If the aluminum is bonded by boric acid, the formation of any gels due to $Al(OH)_3$ is avoided. In the absence of gelatin hardeners containing aluminum, boric acid and/or derivatives thereof can be omitted from the fixing solution, so obtaining a less polluting solution.

The invention will be described hereinafter by reference to the following examples.

EXAMPLES

A tabular grain silver bromide emulsion having an aspect ratio of about 7:1 and average grain thickness 0.17 mm (prepared in the presence of a deionized gelatin having a viscosity at 60° C. in water at 6.67% w/w of 4.6 mPas, a conductibility at 40° C. in water at 6.67% w/w of less than 150 $\mu$S/cm and less than 50 ppm of $Ca^{++}$) was optically sensitized to green light with a cyanine dye. The emulsion was divided into four portions, and each was chemically sensitized with 20 mg/Ag mole of benzothiazoleiodoethylate, 6 mg/Ag mole of potassium tetrachloroaurate, and different amounts of sodium p-toluenethiosulfonate, sodium p-toluenesulfinate, and potassium chloropalladate according to the following Table 1. After each addition, a pause of about one minute was conducted to homogenize the emulsion. After the addition of chemical sensitizers the emulsion was chemically ripened for about 130 minutes at 60° C. At the end of the chemical ripening, non-deionized gelatin (having a viscosity at 60° C. in water at 6.67% w/w of 5.5 mPas, a conductibility at 40° C. in water at 6.67% w/w of 1,100 $\mu$S/cm and 4,500 ppm of $Ca^{++}$) was added to the emulsion in an amount of 83% by weight deionized gelatin and 17% by weight non-deionized gelatin. At the end of the chemical ripening the emulsion was also added with 200 mg/Ag mole of KI and 1.373 g/Ag mole of 5-methyl-7-hydroxy-triazaindolizine stabilizer. Before coating, each emulsion was added with 3 g/Ag mole of resorcinol and with different amounts of a 1,3-bis-vinylsulfonyl-2-propanol hardener according to the following Table 1. Each emulsion was coated on each side of a blue polyester film support at a silver coverage of 2.1 g/m$^2$ per side and gelatin coverage of 1.6 g/m$^2$ per side. A non-deionized gelatin protective supercoat containing 1.1 g/m$^2$ of gelatin per side was applied on each coating at the pH of the emulsion (films A to D). To the tabular grain emulsion of film D, 330 mg/Ag mole of the supersensitizer 1 of table A of the specification were added together with the cyanine dye. The films A to D in the form of sheets were stored for 15 hours at 50° C., exposed to white light and processed in a 3M Trimatic™ XP515 automatic processor, by developing for 27 seconds at 35° C. with a hardener free developing solution, then fixing for 27 seconds at 30° C. with a hardener free fixing solution, and washing with water for 22 seconds at 35° C. and drying for 22 seconds at 35° C. The ready-to-use developing and fixing bath compositions used in processing the above mentioned films are described in the following tables 2 and 3.

TABLE 1

| COMPOUND | | FILM A | FILM B | FILM C | FILM D |
|---|---|---|---|---|---|
| sodium p-toluenesulfinate | g/Ag mole | 6 | 0 | 0 | 0 |
| sodium p-toluenethiosulfonate | mg/Ag mole | 25 | 14.5 | 14.5 | 14.5 |
| potassium chloropalladate | mg/Ag mole | 0 | 0 | 5.2 | 5.2 |
| 1,3-bis-vinylsulfonyl-2-propanol | g/Ag mole | 6.68 | 3.34 | 3.34 | 3.34 |

TABLE 2

| DEVELOPER | | |
|---|---|---|
| Water | g | 700 |
| Na2S2O5 | g | 40 |
| KOH 35% (w/w) | g | 107 |
| K2CO3 | g | 13.25 |
| CH3COOH | g | 7.5 |
| Ethyleneglycol | g | 10 |
| Diethyleneglycol | g | 5 |
| EDTA.4Na | g | 1.5 |
| BUDEX 5103.2Na 40% (w/w) | g | 7.5 |
| Boric acid | g | 1.7 |
| 5-methyl-benzotriazole | g | 0.08 |
| 5-nitro-indazole | g | 0.107 |
| Hydroquinone | g | 20 |
| Phenidone | g | 1.45 |
| Sodium bromide | g | 5 |
| Water to make | l | 1 |
| pH at 20° C. | | 10.35 |

TABLE 3

| FIXER | | |
|---|---|---|
| $(NH_4)_2S_2O_3$ 60% (w/w) | g | 242 |
| $Na_2SO_3$ | g | 8.12 |
| $NH_4OH$ 25% (w/w) | g | 15 |
| $CH_3COOH$ | g | 20 |
| KI | g | 0.05 |
| Water to make | l | 1 |
| pH at 20° C. | | 5.0/5.2 |

The photographic characteristics of the films A to D are shown in the following table 4.

TABLE 4

| FILM | Dmin | Blue Speed | Green Speed | X-ray Speed | Average Contrast | Shoulder Contrast | Dmin 15 hours 70° C. |
|---|---|---|---|---|---|---|---|
| A (R) | 0.21 | 1.97 | 2.43 | 2.40 | 2.40 | 3.00 | 0.25 |
| B (C) | 0.235 | 1.94 | 2.38 | 2.35 | 2.40 | 3.00 | 0.27 |
| C (I) | 0.21 | 1.93 | 2.37 | 2.35 | 2.41 | 3.10 | 0.22 |
| D (I) | 0.21 | 1.96 | 2.41 | 2.39 | 2.40 | 2.95 | 0.22 |

Note:
R = Reference
C = Control
I = Invention

The reference film A shows undesirable white streaks after development due to the interaction of sodium p-toluenesulfinate with the 1,3-bis-vinylsulfonyl-2-propanol hardener. Control film B does not show the defect, but the absence of p-toluenesulfinate significantly reduces the photographic performances of this film; in particular, the high values of Dmin on both fresh and aged samples is unacceptable.

The films C and D of the present invention do not show any of the above mentioned adverse effects. Films C and D do not show any trace of the white streaks defect. Further, the presence of the palladium compound significantly improves the photographic performances in terms of lower Dmin on both fresh and aged samples. The reduction of the amount of hardener is another valuable advantage in terms of environmental impact and production costs. The supersensitizer added in the film D further improves the speed of the resulting silver halide element.

What is claimed is:

1. A light-sensitive silver halide photographic element comprising a support and at least one hydrophilic colloid layer comprising a binder and a vinylsulfonyl hardener coated thereon, wherein at least one of said hydrophilic colloid layers is a silver halide emulsion layer consisting essentially of tabular silver halide grains having an average diameter:thickness ratio of at least 3:1, characterized in that said tabular silver halide grains are chemically sensitized by at least one gold sensitizer and at least one thiosulfonate sensitizer in the presence of a palladium compound added during chemical sensitization.

2. The light-sensitive silver halide photographic element of claim 1 wherein the gold sensitizer is selected from the group consisting of chloroaurate and aurothiocyanate compounds.

3. The light-sensitive silver halide photographic element of claim 1 wherein the amount of gold sensitizer is from 1 to 20 mg/Ag mole.

4. The light-sensitive silver halide photographic element of claim 1 wherein the thiosulfonate sensitizer is represented by the formula

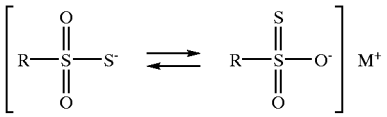

wherein R represents an aliphatic group, an aromatic group or a heterocyclic group and $M^+$ represents a cation.

5. The light-sensitive silver halide photographic element of claim 1 wherein the amount of thiosulfonate sensitizer is from 0.001 to 0.1 g/Ag mole.

6. The light-sensitive silver halide photographic element of claim 1 wherein the palladium compound is represented by $R_1PdX_6$ or $R_1PdX_4$ wherein $R_1$ represents a hydrogen atom, an alkali metal atom or an ammonium group, and X represents a halogen atom.

7. The light-sensitive silver halide photographic element of claim 1 wherein the amount of palladium compound is from 0.001 to 0.01 g/Ag mole.

8. The light-sensitive silver halide photographic element of claim 1 wherein the palladium compound is added after the addition of said gold and thiosulfonate sensitizers.

9. The light-sensitive silver halide photographic element of claim 1 wherein said vinylsulfonyl hardener is a bi-, tri- or tetra-vinylsulfonyl substituted organic hydroxy compound of formula $(CH_2{=}CH{-}SO_2{-})_n{-}A$, wherein A is an n-valent organic group containing at least one hydroxy group and n is 2, 3 or 4.

10. The light-sensitive silver halide photographic element of claim 9 wherein the group A represents an n-valent acyclic hydrocarbon group, a 5 or 6 membered heterocyclic group containing at least one nitrogen, oxygen or sulfur atom, a 5 or 6 membered alicyclic group or an aralkylene group having at least 7 carbon atoms.

11. The light-sensitive silver halide photographic element of claim 1, wherein said tabular silver halide grains are spectrally sensitized by at least one cyanine dye and at least one supersensitizer.

12. The light-sensitive silver halide photographic element of claim 11, wherein said supersensitizer is a polymeric compound comprising an aminoallylidenemalononitrile moiety.

13. The light-sensitive silver halide photographic element of claim 12, wherein said supersensitizer is a copolymer comprising an ethylenically unsaturated monomer and an allyl monomer including said aminoallylidenemalononitrile moiety.

14. The light-sensitive silver halide photographic element of claim 11, wherein said cyanine dye is added in an amount of from 10 to 100 mg/Ag mole.

15. The light-sensitive silver halide photographic element of claim 11, wherein said supersensitizer is added in an amount of from 10 to 1,000 mg/Ag mole.

16. The light-sensitive silver halide photographic element of claim 1 wherein said tabular silver halide grains have an average diameter:thickness ratio of 3:1 to 8:1.

17. The light-sensitive silver halide photographic element of claim 1 wherein said tabular silver halide grains have an average diameter ranging from about 0.3 to 5 $\mu$m.

18. The light-sensitive silver halide photographic element of claim 1 wherein said tabular silver halide grains have an average thickness of 0.4 $\mu$m or less.

19. The light-sensitive silver halide photographic element of claim 1 wherein not less than 40% of the silver halide grains are tabular silver halide grains having an average diameter:thickness ratio of at least 3:1.

20. A light-sensitive silver halide element for use in radiography with intensifying screens comprising a transparent support having on both sides silver halide emulsion layers, wherein at least one of said silver halide emulsion layers consists essentially of tabular silver halide grains having an average diameter:thickness ratio of at least 3:1 and highly deionized gelatin hardened with a vinylsulfonyl hardener, characterized in that said tabular silver halide grains are chemically sensitized by at least one gold sensitizer and at least one thiosulfonate sensitizer in the presence of a palladium compound added during chemical sensitization.

* * * * *